US005443366A

United States Patent [19]

Knott et al.

[11] Patent Number: 5,443,366

[45] Date of Patent: Aug. 22, 1995

[54] GAS TURBINE ENGINE FAN BLADE ASSEMBLY

[75] Inventors: David S. Knott; Czeslaw Paluszkiewicz, both of Loughborough; Martyn P. Adams, Leicestershire; Sivasubramaniam K. Sathianathan, Burton-on-Trent, all of England

[73] Assignee: Rolls-Royce plc, London, England

[21] Appl. No.: 137,785

[22] Filed: Oct. 19, 1993

[30] Foreign Application Priority Data

Nov. 11, 1992 [GB] United Kingdom ..... 9223593

[51] Int. Cl.[6] ..... F01D 5/30

[52] U.S. Cl. ..... 416/221; 416/220 R

[58] Field of Search ..... 416/220 R, 221, 248

[56] References Cited

U.S. PATENT DOCUMENTS

| | | | |
|---|---|---|---|
| 3,653,781 | 4/1972 | Cooper | 416/221 |
| 3,986,779 | 10/1976 | Beckershoff | 416/221 |
| 4,474,535 | 10/1984 | Dhuic . | |
| 4,478,554 | 10/1984 | Surdi . | |
| 4,527,952 | 7/1985 | Forestier et al. . | |
| 5,282,720 | 2/1994 | Szpunar | 416/220 R |

FOREIGN PATENT DOCUMENTS

| | | | |
|---|---|---|---|
| 1523422 | 3/1978 | European Pat. Off. . | |
| 0068923 | 5/1983 | European Pat. Off. . | |
| 0976790 | 11/1950 | France | 416/220 R |
| 2492906 | 4/1982 | France | 416/221 |
| 1206577 | 1/1986 | U.S.S.R. | 416/220 R |

*Primary Examiner*—Edward K. Look
*Assistant Examiner*—Mark Sgantzos
*Attorney, Agent, or Firm*—Cushman Darby & Cushman

[57] ABSTRACT

A fan blade assembly for a ducted fan gas turbine engine comprises a hub which carries an annular array of radially extending fan blades. Each fan blade has a root portion which locates in a corresponding groove in the hub. Aligned radial slots in the root portion and groove accommodate a U-shaped key which provides axial retention of the root portion in its groove. A flat spring attached to the underside of the root portion maintains the key in position and permits manual deflection of the key to assist blade assembly and disassembly.

14 Claims, 2 Drawing Sheets

GAS TURBINE ENGINE FAN BLADE ASSEMBLY

BACKGROUND OF THE INVENTION

1. Field of the Invention

This invention relates to a ducted fan gas turbine engine fan blade assembly and is particularly concerned with the manner in which the fan blades in such an assembly are locked in position on the rotor disc or hub which carries them.

2. Description of the Prior Art

Modern ducted fan gas turbine engines are provided with a front fan which provides both propulsive thrust and a supply of air for the gas generator core of the engine. Typically such fans comprise a hub having a plurality of generally axially extending grooves in its periphery which receive the roots of the fan blades. The grooves and roots are usually of corresponding generally dovetail cross-section shape so as to ensure radial retention of the fan blades.

It is necessary for assembly and maintenance purposes that each of the fan blades should be easily removable from its respective groove in the hub. One way of achieving this is to provide fixed stops at the rearward ends of the hub grooves which the fan blade roots are slid up to. A retention ring is then bolted on to the front of the hub to ensure that forward motion of the roots in their grooves is prevented. While this method of retaining blades is effective for small to medium size engines, it can be less suitable for large engines because of the weight problem associated with a retention ring which is sufficiently robust to ensure effective blade root retention.

An alternative way of retaining fan blades in their slots is described in GB1523422. In that specification, there is described a fan blade assembly in which the fan blades are axially retained by means of a U-shaped bar. The bar locates in appropriate aligned slots in the blade root and hub to provide axial retention. The blade roots and part of the hub rim are partially extended in an upstream direction so as to accommodate the U-shaped bars. A lip provided on a fairing attached to the front face of the hub cooperates with a ring to maintain the U-shaped bars in position.

While such a method of fan blade retention is effective, the extension of the hub rim and blade roots in an upstream direction does give rise to undesirable weight penalties. Moreover it can be difficult to remove a single fan blade for maintenance purposes without disturbing the remaining fan blades. Additionally there can be difficulty in manipulating the U-shaped bars during the installation and removal of the fan blades.

SUMMARY OF THE INVENTION

It is an object of the present invention to provide a gas turbine engine fan blade assembly in which such weight penalties and difficulties of fan blade retention are substantially avoided.

According to the present invention, a fan blade assembly for a ducted fan gas turbine engine comprises a hub and an annular array of fan blades extending radially outwardly from said hub, each of said fan blades having a root portion which locates in one of a plurality of correspondingly shaped generally axially extending grooves in the periphery of said hub to provide radial retention of said fan blades, each of said fan blade root portions and its corresponding hub groove being provided with generally radially extending slots, each slot in said hub groove being aligned with a corresponding slot in its associated fan blade root portion, key means being provided to locate in said aligned slots and resilient biasing means being associated with each of said key means, said resilient biasing means being positioned to bias each of said key means into a first position in which it locates in said aligned slots to prevent relative axial movement between said fan blade root portions and said hub, from a second position in which said key means does not prevent such relative axial movement, whereby retention of said key means in said second position permits axial assembly and disassembly of each of said fan blade root portions and its corresponding hub groove, locking means being provided to selectively lock each of said key means in said first position.

BRIEF DESCRIPTION OF THE DRAWINGS

The present invention will now be described, by way of example, with reference to the accompanying drawings in which.

DETAILED DESCRIPTION OF THE PREFERRED EMBODIMENT

Figure 1:
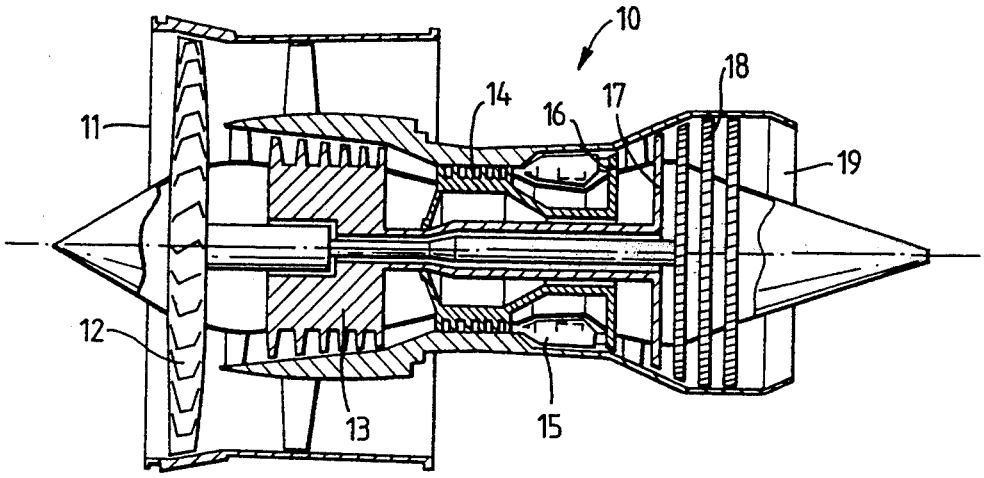
FIG. 1 is a schematic sectioned side view of a ducted fan gas turbine engine having a fan blade assembly in accordance with the present invention.

Referring to FIG. 1, a ducted fan gas turbine engine generally indicated at 10 is of conventional configuration. It comprises an air inlet 11 in which is located a ducted fan blade assembly 12. The fan blade assembly 12 accelerates air drawn in through the inlet 11. That air flow is then divided into two flows. The first flow bypasses the remainder of the engine 10 and provides propulsive thrust. The second flow is directed into an intermediate pressure compressor 13 and subsequently into a high pressure compressor 14 where various stages of compression of the air take place. The compressed air is then directed into a combustor 15 where fuel is mixed with the air and the mixture combusted. The resultant hot combustion products then expand through high, intermediate and low pressure turbines 16,17 and 18 respectively before being exhausted to atmosphere through an exhaust nozzle 19.

The high, intermediate and low pressure turbines 16,17 and 18 respectively drive the high and intermediate pressure compressors 14 and 13 and the ducted fan blade assembly 12 by appropriate coaxial shafts.

Figure 2:
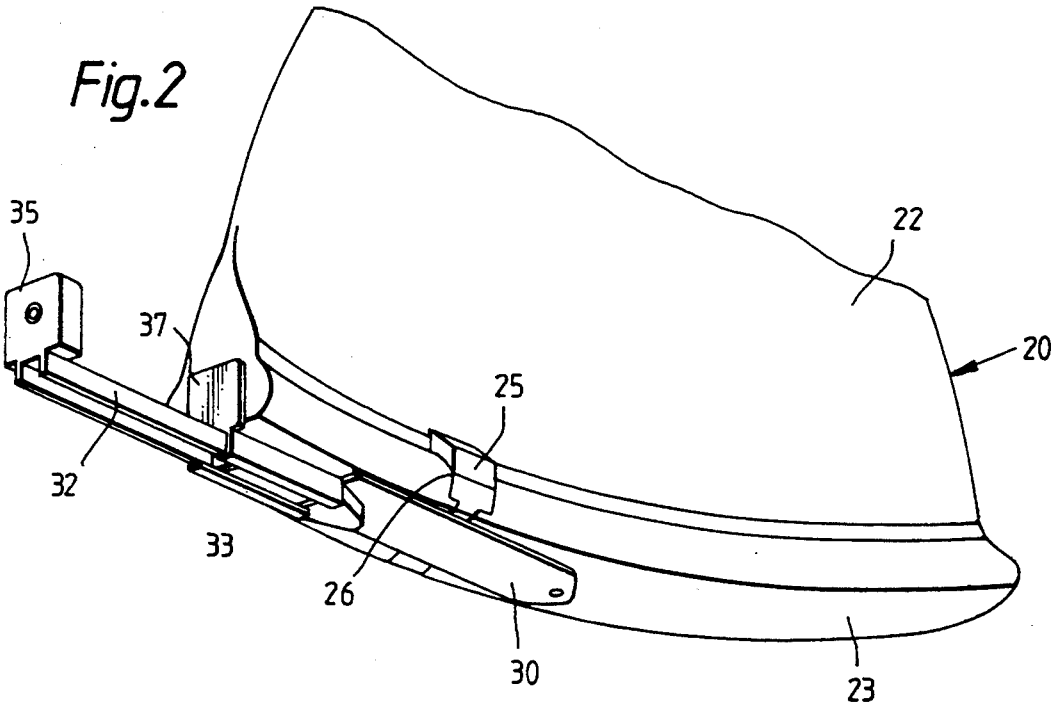
FIG. 2 is a view of the radially inward region of one of the fan blades of the ducted fan gas turbine engine shown in FIG. 1.
Figure 3:
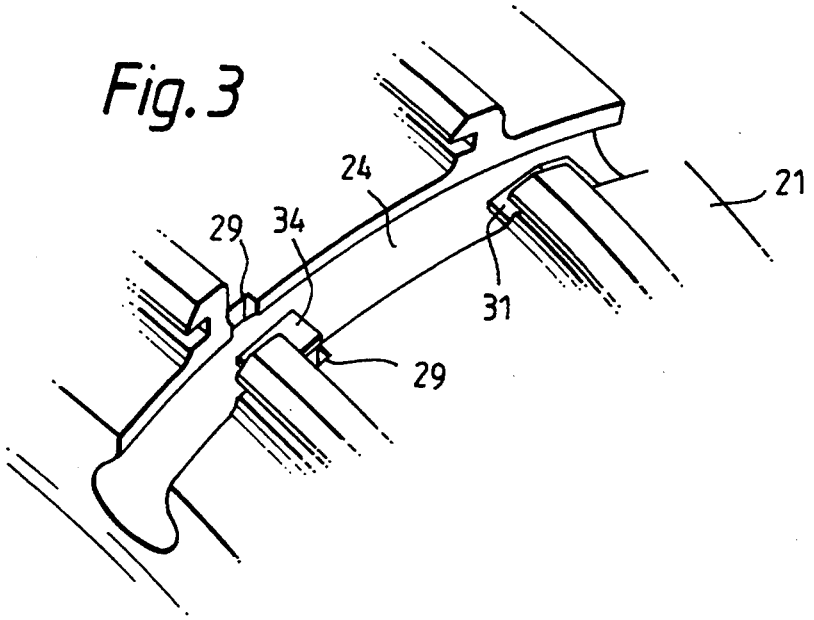
FIG. 3 is a view of one of the grooves in the hub of the fan blade assembly shown in FIG. 1 for receiving the fan blade shown in FIG. 2.

The fan blade assembly 12 comprises an annular array of radially extending fan blades, part of one of which 20 can be seen in FIG. 2, which are located upon a hub 21, part of which can be seen in FIG. 3.

Each fan blade 20 comprises an aerofoil portion 22 and a root portion 23. The root portion 23 is of approximately 0 dovetail cross-sectional configuration. A plurality of generally axially extending grooves 24 of corresponding cross-sectional configuration are provided in the hub 21 to receive the root portions 23. It will be seen therefore that when the fan blade root portions 23 are located in their corresponding grooves 24 in the hub 21, they are radially anchored.

Figure 6:
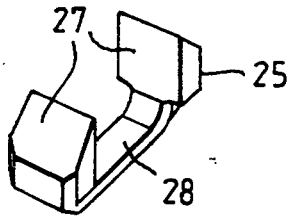
FIG. 6 is a view of the key which provides axial locking of the fan blade in its corresponding hub groove.

The axial retention of each fan blade root portion 23 in its corresponding hub groove 24 is provided by a key 25 which, as can be seen in FIG. 6, is of generally U-shaped configuration. The key 25 locates in generally radially extending slots 26 provided in the fan blade root portion 23. One slot 26 is provided on each side of the root portion 23 so that each slot 26 receives one arm 27 of the key. A further circumferentially extending slot (not shown) is provided in the base of the root portion 23 to receive the bridging piece 28 of the key 25 which interconnects its arms 27.

The groove 24 in the hub 21 which receives the fan blade root portion 23 is, as can be seen in FIG. 3, also provided with two generally radially extending slots 29 in its radially outward region. The axial extent of each of the hub slots 29 is approximately equal to the thickness of the arms 27 of the key 25. When the fan blade root portion is correctly positioned within the fan hub 21, the slots 26 and 29 in the root portion 23 and hub groove 24 respectively are radially aligned. This permits the arm 27 of the key 25 to simultaneously locate in the root slots 26 and hub groove slots 29. As a consequence of this, the fan blade root portion 23 is prevented by the key 25 from translating axially relative to the hub 21.

Figure 4:
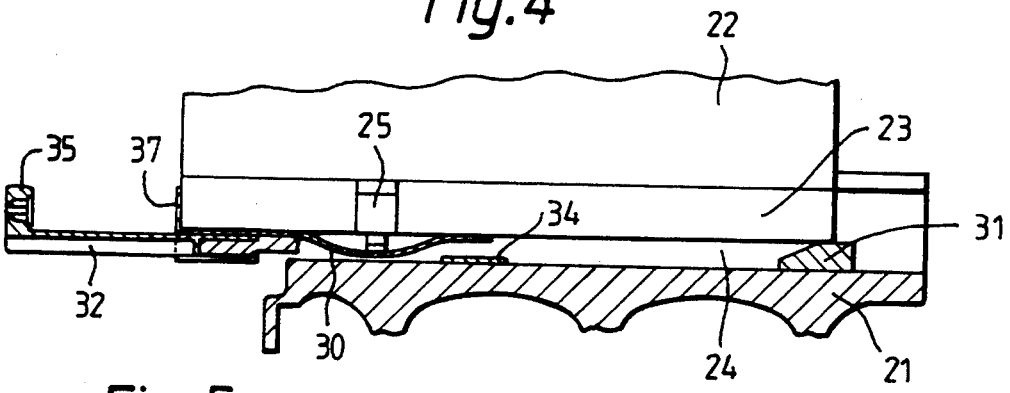
FIG. 4 is a sectioned side view of the fan blade shown in FIG. 2 being assembled into the hub groove shown in FIG. 3.

Referring to FIG. 2, when the fan blade 20 is not in place on the hub 21, the key 25 is held in place in the slots 26 in the root portion 23 by a flat leaf spring 30. The spring 30 is made from spring steel and is attached to the underside of the root portion 23 so as to engage the bridging piece 28 of the key 25. As can be seen in FIG. 4, the key may be manually depressed radially inwardly against the resilience of the spring 30. When the key 25 is so depressed, the fan blade root portion 23 can be fed into the hub groove 24. In order to accommodate key 25 and spring 30 when so depressed, the hub groove 24 is deeper than the fan blade root portion 23. When the root portion 23 has been fully fed into the hub groove 24, the slots 26 and 29 become aligned, so permitting the key 25 to be urged by the spring 30 into the groove slots 29. This, as stated earlier, axially locks the fan blade root portion 23 relative to the hub groove 24.

In order to ensure that each of the fan blade root portions 23 is properly located within its hub groove 24, an inclined step 31 is provided at the downstream end of the hub groove 24 to support the downstream end of the fan blade root portion 23. Additionally a removable support 32 is provided at the upstream end of the hub groove 24. The removable support 32 is slidably retained within a support member 33 which is located at the upstream end of the fan blade root portion 23. In the present embodiment, the support member 33 is defined by an extension of the spring 30. However, it will be appreciated that the support member 33 need not be part of the spring 30 if so desired.

Figure 5:
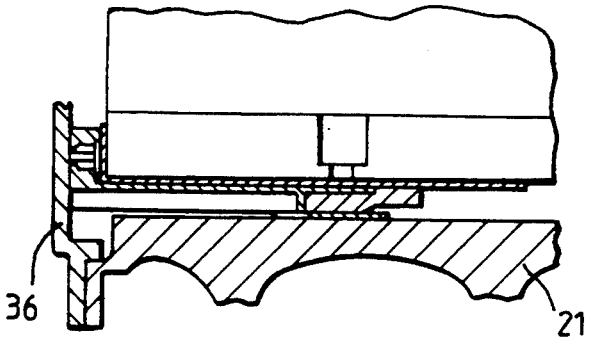
FIG. 5 is a sectioned side view similar to that shown in FIG. 4 but showing the fan blade fully located within its corresponding hub groove.

In addition to providing correct location of the upstream end of the fan blade root portion 23, the removable support 32 also functions as a lock to lock the key 25 in position. It does this by bridging the gap between the underside of the spring 30 and the bottom of the hub groove 24 as can be seen in FIG. 5. A rubber pad 34 is located on the bottom of the hub groove 24 to engage the removable support 32, thereby ensuring a tight, vibration-free fit for the removable support 32 and preventing blade movement during windmilling of the fan blade assembly.

The upstream ends of the removable supports 32 are modified to define stops 35 which engage extensions 37 of the springs 30 which themselves abut the upstream face of the fan blade root portion 23. A lightweight cover plate 36 which is attached to the upstream face of the hub 21 engages the stops 35, thereby maintaining the removable supports 32 in position against the spring extensions 37.

A further advantage which arises from the use of the removable supports 32 is that they facilitate easy insertion of the root portions 23 into and removal from their associated hub grooves 24. When the removable supports 32 are in place, they ensure that the root portions fit tightly within the hub groove 24. However when they are removed, the root portions 23 can be easily slid out of the hub groove 24 without any danger of jamming.

Although the present invention has been described with reference to the use of a flat spring 30 made from spring steel, it will be appreciated that other resilient materials could be used in its place. Thus, for instance, rubber could be used in place of spring steel.

It will be seen therefore that the present invention provides an effective means for providing axial restraint of a fan blade root portion in a hub groove which is very easy to use. Moreover it is light in weight. In addition, since the key 25 is effectively part of its associated fan blade 20, there is little danger of the key 25 being omitted.

It will also be appreciated that although only one key 25 is shown as being associated with each fan blade root portion, more than one key 25 per root portion 23 could be provided if so desired.

We claim:

1. A fan blade assembly for a ducted fan gas turbine engine comprising a hub and an annular array of fan blades extending radially outwardly from said hub, each of said fan blades having a root portion which locates in one of a plurality of correspondingly shaped, generally axially extended grooves in the periphery of said hub to provide radial retention of said fan blades, each said root portion having an axial extent substantially the same as that of said respective groove and leading and trailing ends, each of said fan blade root portions and its corresponding hub groove being provided with generally radially extending slots with said slots being located intermediate said ends of said root portions and said hub grooves, each slot in said hub groove being aligned with a corresponding slot in its associated fan blade root portion, key means being provided to locate in said aligned slots and resilient biasing means being associated with each of said key means, each said resilient biasing means comprising a leaf spring which is positioned so as to extend parallel to said axial extent of an associated root portion to bias each of said key means into a first position in which it locates in said aligned slots to prevent relative axial movement between said fan blade root portions and said hub, from a second position in which said key means does not prevent such relative axial movement, whereby retention of said key means in said second position permits axial assembly and disassembly of each of said fan blade root portions and its corresponding hub groove, locking means being provided to selectively lock each of said key means in said first position.

2. A fan blade assembly as claimed in claim 1 wherein said key means is of generally U-shaped configuration, the arms of said U-shaped key means locating in said aligned slots.

3. A fan blade assembly as claimed in claim 1 wherein said resilient biasing means is attached to each of said fan blades to maintain its associated key means in position on said fan blade upon the removal of that fan blade from said hub.

4. A fan blade assembly as claimed in claim 3 wherein said resilient biasing means comprises a leaf spring.

5. A fan blade assembly as claimed in claim 4 wherein said resilient biasing means is located on the radially inward surface of the root portion of its associated fan blade.

6. A fan blade assembly as claimed in claim 4 wherein said resilient biasing means is formed from spring steel.

7. A fan blade assembly as claimed in claim 1 wherein said locking means to selectively lock each of said key means in said first position comprises a removable support which is in operation interposed between said key means and said hub.

8. A fan blade assembly as claimed in claim 7 wherein a radial space is defined between the radially inward surface of each of said fan blade root portions and the radially inward surface of their corresponding hub grooves, one of said locking means being located in each of said so-defined radial spaces.

9. A fan blade assembly as claimed in claim 7 wherein each of said locking means is so configured as to provide support for its associated fan blade root portion within the hub groove in which said root portion is located.

10. A fan blade assembly as claimed in claim 7 wherein said locking means is arranged to be inserted between said key means and said hub from the upstream end of said hub.

11. A fan blade assembly as claimed in claim 10 wherein said locking means is maintained in position between said key means and said hub by a cover plate attached to the upstream end of said hub.

12. A fan blade assembly as claimed in claim 1 wherein each of said fan blade root portions is of approximately dovetail cross-sectional configuration.

13. A fan blade assembly as claimed in claim 1 wherein said locking means engages and supports said resilient biasing means.

14. The invention as claimed in claim 1 wherein each said leaf spring has opposite ends which are respectively attached to said associated root portion.

* * * * *